United States Patent [19]

Grilliot et al.

[11] Patent Number: 4,864,742

[45] Date of Patent: Sep. 12, 1989

[54] FIREFIGHTER'S BOOT MATED TO FIREFIGHTER'S TROUSERS

[76] Inventors: William L. Grilliot; Mary I. Grilliot, both of 1986 Home Ave., Dayton, Ohio 45417

[21] Appl. No.: 204,291

[22] Filed: Jun. 9, 1988

[51] Int. Cl.[4] ..... A43B 23/02; A43B 1/10; A41D 13/00

[52] U.S. Cl. ..... 36/109; 36/4; 2/81; 2/227

[58] Field of Search ..... 36/109.4, 72 R, 71, 36/113, 83; 2/81, 227

[56] References Cited

U.S. PATENT DOCUMENTS

| | | | |
|---|---|---|---|
| 2,697,886 | 12/1954 | Spinali | 36/4 |
| 3,308,560 | 3/1967 | Jones | 36/4 |
| 3,531,878 | 10/1970 | Corry | 36/109 |
| 3,743,623 | 7/1973 | Groothaert | 36/4 |
| 3,925,823 | 12/1975 | Kupferman | 2/81 |
| 4,627,112 | 12/1986 | Grilliot et al. | 2/81 |
| 4,768,233 | 9/1988 | Grilliot et al. | 2/81 |

FOREIGN PATENT DOCUMENTS 3014728 10/1980 Fed. Rep. of Germany ..... 36/4

*Primary Examiner*—James Kee Chi

*Attorney, Agent, or Firm*—Jacox & Mechstroth

[57] ABSTRACT

A firefighter's boot of this invention is of a configuration and has dimensions which provide a boot which is significantly lighter in weight than a conventional boot of a firefighter which is constructed of the same material. Thus, stress upon a firefighter is significantly less than when a conventional boot is worn by the firefighter. A firefighter's boot of this invention is adapted to be worn in conjunction with firefighter's trousers which cover the legs of the firefighter. A firefighter's boot of this invention is relatively short in height and has a dimension to provide protection which, under certain conditions, may not be provided by the trousers. The firefighter's boots and trousers are adapted to be stored as a unit. The firefighter's boot of this invention is of sufficient height to extend above firefighter's trousers which are compressed around the boots for storing the boots and trousers as a unit. The boot has a hand-grasp element which may be grasped by a firefighter for donning the boot and for support of the boot.

4 Claims, 1 Drawing Sheet

FIREFIGHTER'S BOOT MATED TO FIREFIGHTER'S TROUSERS

BACKGROUND OF THE INVENTION

Firefighters have traditionally worn boots which are made of rubber. When the traditional boots are worn, the upper edge of the boots is positioned immediately below the knees of the firefighter. Rubber boots have traditionally been used because of the excellent dielectric characteristics of rubber material. Furthermore, rubber boots are resistant to hazardous materials and resistant to moisture and heat.

A firefighter normally wears protective trousers which cover at least a portion of the firefighter's boots. The firefighter's trousers and boots are normally removed together as a unit from the firefighter, and the trousers are pushed down or compressed around the boots. Thus, the trousers and boots are normally stored as a unit. Conventional firefighter boots are referred to as "knee-high" boots. The knee-high boots are sufficiently high that they extend upwardly from the trousers as the trousers, in the stored, compressed condition, encompass the boots. When an alarm occurs, the firefighter can quickly respond as the firefighter steps through the legs of the trousers and into the boots and pulls the trousers up to the waist for fastening the trousers in the proper position. Thus, the firefighter can quickly and easily don the boots and trousers simultaneously. Of course, alarm response time is a very important factor by which fire departments are judged, because the quicker the fire department responds to an alarm, the greater is the likelihood for quickly containing the unfavorable situation.

Even though rubber boots are particularly suited to meet the footwear needs of a firefighter, rubber boots have significant limitations. Rubber boots are relatively heavy in weight. Stress is the leading cause of firefighters' deaths and injuries. The weight of protective clothing is one of the factors that causes stress in firefighters. Because stress is such an important factor for fire departments to consider when protective clothing is chosen or designed, the weight of rubber footwear has drawn considerable criticism. Many fire departments have chosen leather boots, because the leather boots generally are lighter in weight. However, the leather boots are less protective.

It is an object of this invention to provide a firefighter's boot which can be made of rubber or rubber-like material but which is significantly lighter in weight than the conventional rubber boot of a firefighter.

It is another object of this invention to provide such a rubber or rubber-like boot for a firefighter in which the boot, even though lighter in weight, is of a configuration and dimensions which provide all of the necessary protection required of a firefighter's boot.

It is another object of this invention to provide such a firefighter's boot which has sufficient height to extend upwardly from trousers which are compressed around the boot, as the boot and the trousers are stored as a unit.

It is another object of this invention to provide such a firefighter's boot which includes means for grasping the boot for support of the boot for donning the boot and for moving the boot.

Other objects and advantages of the firefighter's boot of this invention reside in the construction and configuration of the boot, materials employed, the method of production and the mode of use, as will become more apparent from the following description.

SUMMARY OF THE INVENTION

A firefighter's boot of this invention is preferably, but not necessarily, of rubber or rubber-like material. Thus, the boot has all of the superior protective qualities of rubber. The firefighter's boot of this invention is created with the recognition that a firefighter's boot does not need to be knee-high. Furthermore, a firefighter's boot needs to have its greatest height only through a part of the circumference of the boot. The highest portions of a firefighter's boot may be spaced significantly below the firefighter's knee. The highest portions of a firefighter's boot need only provide:

a) shin protection, b) a guide to foot movement into the boot during donning, and c) capability of retaining the firefighter's trousers in position below the upper portion of the boot as the trousers are pushed down or compressed around the boot for storing of a pair of the boots and trousers as a unit.

This invention pertains to a firefighter's boot which has a configuration and dimensions which minimize certain non-functional portions of the firefighter's boot. The firefighter's boot of this invention covers and meets requirements of shin protection, provides proper guide for foot movement into the boot for donning, and is of a height necessary for retaining the trousers in position below the upper portion of the boot during storing of boots and trousers as a unit.

The firefighter's boot of this invention is also constructed to meet and to comply with all of the regulations pertaining to firefighter's boots.

DETAILED DESCRIPTION OF THE INVENTION

Figure 1:
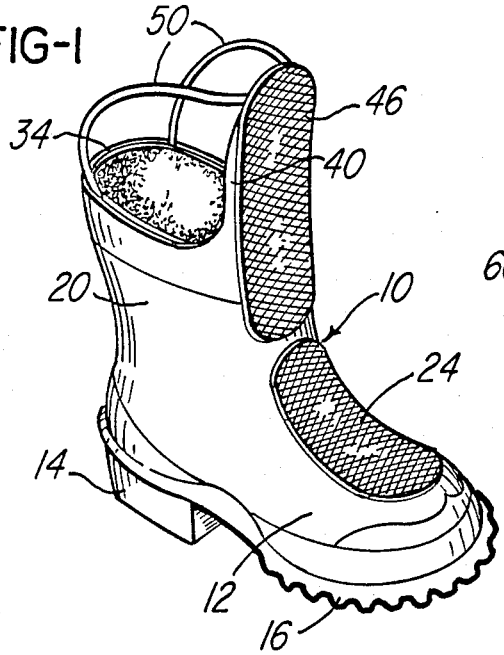
FIG. 1 is a perspective front view of a firefighter's boot of this invention.

The figures show a firefighter's boot 10 of this invention. The boot 10 has a foot portion 12 which is provided with a heel 14 and a sole 16. The boot 10 also has an upper portion 20 which extends upwardly from the foot portion 12.

Covering a part of the foot portion 12 is a protective pad 24.

The upper portion 20 is shown as having a substantially planar upper edge 34. The upper portion 20 has a guide part 40, which extends upwardly from the upper edge 34. Attached to the guide part 40, and extending downwardly therefrom, is a shin guard 46.

Preferably, the upper edge 34 of the upper portion 20 is about eight inches above the heel 14. Preferably, but not necessarily, the guide part 40 of the upper portion 20 has a dimension of between two inches and eight inches above the upper edge 34.

Attached to the guide part 40 and to the upper edge 34 are hand-grasp members 50.

As stated above, a firefighter's boots 10 are adapted to be worn and used with firefighter's trousers 60.

Figure 2:
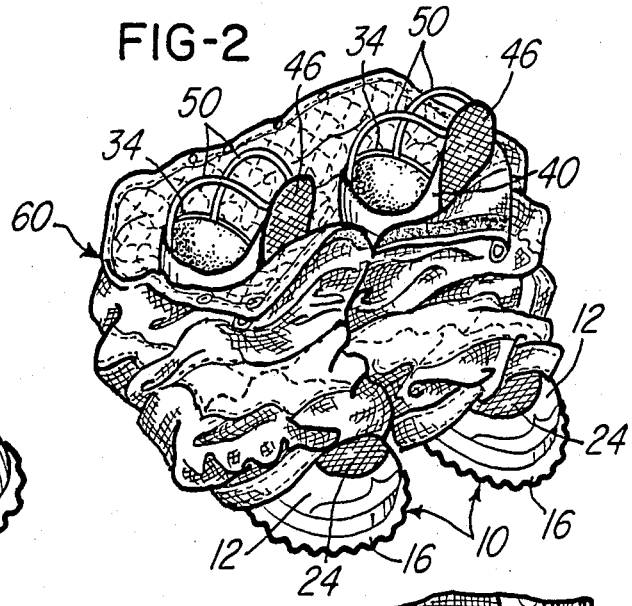
FIG. 2 is a perspective view, drawn on a slightly smaller scale than FIG. 1, illustrating a pair of boots of this invention, with a pair of trousers encompassing the boots, as the boots and trousers are stored as a unit, for quick donning by a firefighter.

When a pair of firefighter's boots 10 of this invention and a pair of firefighter's trousers 60 are stored, as illustrated in FIG. 2, the trousers 60 are compressed and encompass the boots 10. The guide part 40 of the upper portion 20 of the boots 10 extends above the trousers 60. Also, the hand-grasp members 50 are positioned above the trousers 60. The hand-grasp members 50 of each boot 10 are grasped by a firefighter as the boot 10 is donned. Also, the hand-grasp members 50 can be grasped by a firefighter for lifting and carrying the boots 10 and the trousers 60 as a unit. Thus, when an alarm occurs, a firefighter can quickly don the boots 10 and the trousers 60 as the firefighter's feet move through the trousers 60 and are placed into the boots 10, and the trousers 60 are pulled up to the firefighter's waist.

Figure 3:
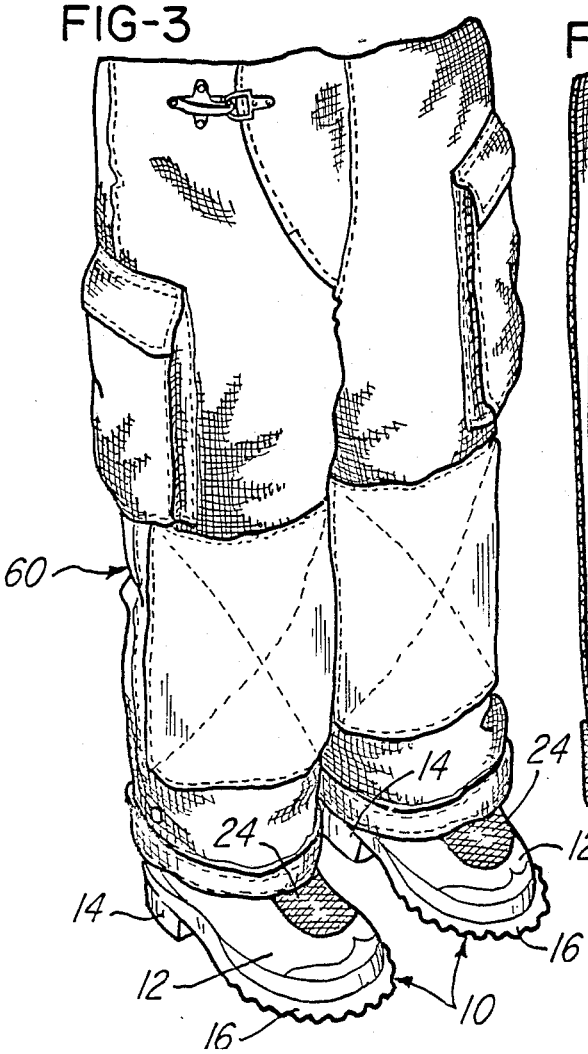
FIG. 3 is a fragmentary perspective view showing the boots and the trousers of FIG. 2, after donning of the boots and trousers.
Figure 4:
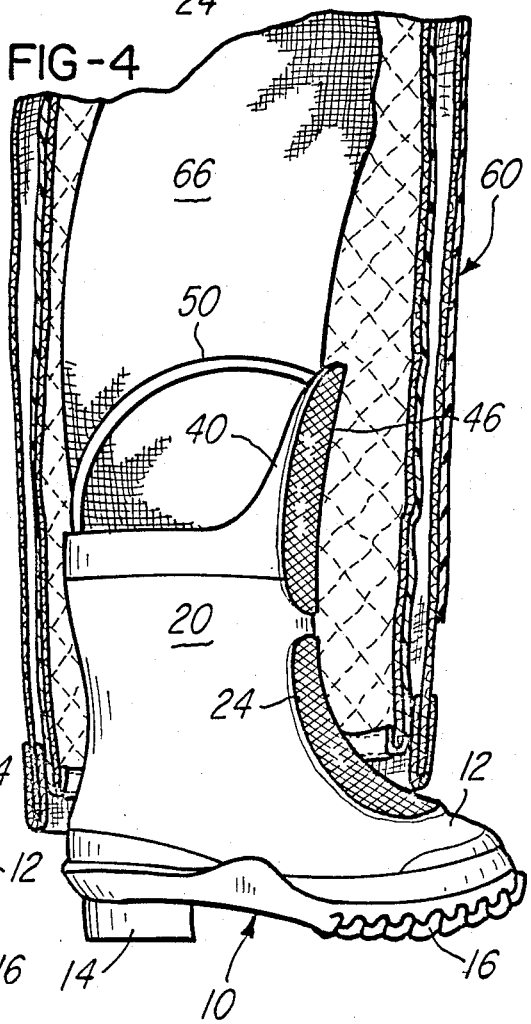
FIG. 4 is a fragmentary sectional view, drawn on substantially the same scale as FIG. 1, showing a boot of this invention within a trouser leg after the boot and the trousers have been donned.

When the boots 10 and trousers 60 are donned, they appear substantially as illustrated in FIGS. 3 and 4. As shown, the guide part 40 of each boot 10 with the shin guard 46 attached thereto protects the forward lower part of a firefighter's leg 66. Due to the fact that the trousers 60 are of flame, heat, and moisture protective materials, the boot 10 does not need to extend up to the knee of the firefighter. The trousers 60 protect the entire leg of the firefighter, from the foot portion 12 upwardly. The trousers 60 protect the legs of the firefighter against flame, heat, and moisture.

Due to the fact that the trousers 60 provide protection for the entire leg of a firefighter, the boots 10 have a configuration and construction which provide footwear for a firefighter and flame, heat, and moisture protection only in limited areas of a firefighter's leg. In the event that the lower part of the trousers 60 should rise above the firefighter's feet during bending or crawling, the boots 10 provide protection to the lower portions of the legs of the firefighter.

The boots 10 include the hand-grasp elements which assist the firefighter in supporting the boots 10. The boots 10 include the guide part 40 which assists in guiding a firefighter's foot into the boot. The boots 10 have the protective pad 24 and the shin guard 6 which protect against impact or the like. The upper portion 20 and the guide part 40 of each boot 10 also provide a degree of protection against impact. The upper portion 20 and the guide part 40 are of value in supporting the shin guard 46 and the hand-grasp members 50.

SUMMARY

Thus, it is understood that a firefighter's boot 10 of this invention may be constructed entirely of rubber or rubber-like materials. However, the firefighter's boot 10 of this invention is substantially lighter in weight than a conventional rubber boot of a firefighter. The boot 10 provides protection only by the firefighter's trousers 60. Furthermore, the boot 10 of this invention includes the guide part 40 which serves as a guide as a foot is moved into the boot 10, and the guide part 40 also supports the shin guard 46. The boot 10 also has the protective pad 24.

Thus, it is understood that a firefighter's boot 10 of this invention constitutes adequate protection for the feet and lower leg portions of a firefighter. The boot 10 which is of significantly less weight than a conventional rubber boot lessens the stress upon a firefighter, while providing adequate protection for the firefighter.

Although the preferred embodiment of the firefighter's boot of this invention has been described, it will be understood that within the purview of this invention various changes may be made in the form, configuration, details, proportion and arrangement of parts, method of construction and materials employed, the combination thereof, and the manner of use, which generally stated consist in a firefighter's boot within the scope of the appended claims.

The invention having thus ben described, the following is claimed:

1. A firefighter's boot having minimum weight while providing adequate protection to the firefighter, the boot being adapted to serve as protection in combination with firefighter's trousers having lower leg parts, the boot having a front region and a rear region, comprising a foot portion, a heel portion at the rear region of the boot, an upper portion which extends upwardly from the heel portion and from the foot portion, the upper portion having an upper edge, the upper edge being about eight inches above the heel portion, a guide portion extending upwardly from the upper edge at the forward section of the boot, the guide portion having a top part about two inches to eight inches above the upper edge, a hand-grasp member attached to the upper portion adjacent the upper edge and at the rear section of the boot, the hand-grasp member also being attached to the guide portion adjacent the top part of the guide portion, the upper portion of the boot and the guide portion of the boot being adapted to be encompassed by the lower leg parts of the firefighter's trousers.

2. The firefighter's boot of claim 1 which is adapted to receive the firefighter's trousers as the trousers are compressed downwardly around the boot and wherein only the guide portion of the boot and the hand-grasp member have parts above the height of the trousers as the trousers are compressed around the boot, whereby the boot and the trousers can be stored and moved as a unit, with the trousers in a compressed condition around the boot and whereby the firefighter can readily grasp the hand-grasp member to don the boot and the firefighter can don the trousers immediately after donning the boot.

3. A firefighter's boot comprising a foot portion which includes a heel portion, an upper portion which extends upwardly from the foot portion, the upper portion having an upper edge, the upper edge being about eight inches above the heel portion, a guide portion which extends upwardly from the upper edge to an extent of about two to eight inches, a hand-grasp element attached to the upper portion of the boot adjacent the upper edge, the hand-grasp element also being attached to the guide portion of the boot, whereby a foot of a firefighter is readily guided into the boot by the guide portion of the boot and as the firefighter grasps the hand-grasp element of the boot.

4. The firefighter's boot of claim 3 in which the upper edge of the upper portion has a forward part and in which the guide portion extends upwardly from the forward part of the upper edge of the upper portion of the boot.

* * * * *

UNITED STATES PATENT AND TRADEMARK OFFICE

CERTIFICATE OF CORRECTION

PATENT NO. : 4,864,742

DATED : September 12, 1989

INVENTOR(S) : William L. Grilliot and Mary I. Grilliot

It is certified that error appears in the above-identified patent and that said Letters Patent is hereby corrected as shown below:

Column 3, line 50, change "6" to ---46---.

Column 3, line 63, after "only" insert ---in areas which need protection which is not provided---.

Column 4, line 16, change "ben" to ---been---.

Signed and Sealed this

Fourteenth Day of August, 1990

*Attest:*

HARRY F. MANBECK, JR.

*Attesting Officer*

*Commissioner of Patents and Trademarks*